United States Patent [19]

Steckenrider

[11] Patent Number: 4,463,696

[45] Date of Patent: Aug. 7, 1984

[54] SEWING MACHINE LOOPER THROW-OUT MECHANISM

[75] Inventor: Paul E. Steckenrider, Hoffman Estates, Ill.

[73] Assignee: Union Special Corporation, Chicago, Ill.

[21] Appl. No.: 360,514

[22] Filed: Mar. 22, 1982

[51] Int. Cl.[3] ..... D05B 57/32

[52] U.S. Cl. ..... 112/200

[58] Field of Search ..... 112/165, 166, 199, 200

[56] References Cited

U.S. PATENT DOCUMENTS

| | | | |
|---|---|---|---|
| 1,850,949 | 3/1932 | Zeier et al. | 112/200 |
| 1,912,959 | 6/1933 | Zeier et al. | 112/199 |
| 2,029,233 | 1/1936 | Hacklander | 112/199 |
| 2,172,321 | 9/1939 | Kucera | 112/200 |
| 2,197,256 | 4/1940 | Kucera | 74/579 R |
| 2,211,619 | 8/1940 | Hacklander et al. | 112/200 |
| 2,239,591 | 4/1941 | Clayton | 112/200 |
| 2,247,570 | 7/1941 | Clayton | 112/200 |
| 2,397,336 | 3/1946 | Clayton | 112/200 |
| 2,688,293 | 9/1954 | Hayes et al. | 112/199 |
| 2,758,557 | 8/1956 | Muecke | 112/200 |
| 3,354,851 | 11/1967 | Covert | 112/200 |
| 3,696,744 | 10/1972 | Etchell | 101/415.1 |
| 4,044,699 | 8/1977 | Marforio | 112/200 |
| 4,091,754 | 5/1978 | Onembo | 112/200 |
| 4,308,971 | 1/1982 | Straub | 220/315 |

FOREIGN PATENT DOCUMENTS

| | | | |
|---|---|---|---|
| 48-75855 | 9/1973 | Japan | 112/200 |

*Primary Examiner*—Wm. Carter Reynolds

*Attorney, Agent, or Firm*—John W. Harbst; John A. Schaerli

[57] ABSTRACT

A looper throw-out mechanism is provided for bodily moving the looper out of its normal operative position for servicing. The throw-out mechanism includes a looper drive shaft having the looper releasably connected thereto, an operator actuated mechanism for selectively disconnecting the looper from its drive shaft to enable free bodily movement of the looper to an inoperative position, and a locking mechanism to prevent undesirable disconnection of the looper from its drive shaft. When looper servicing is desired, the locking mechanism is released by the operator permitting the looper to be disconnected from its actuating shaft and turned to a service position removed from its operative position. Upon its return, the looper is automatically coupled to its drive shaft in an operative position.

1 Claim, 3 Drawing Figures

SEWING MACHINE LOOPER THROW-OUT MECHANISM

FIELD OF THE INVENTION

This invention relates to chain stitch sewing machines having one or more loopers and, more particularly, to a mechanism capable of selectively moving the looper away from its normal operative position to be readily available for servicing.

BACKGROUND OF THE INVENTION

In the majority of chain stitch sewing machines, one or more thread carrying loopers are employed to carry their thread through the needle thread loop formed beneath the fabric. This action allows the thread to be concatenated into a stitch in the workpiece. In such machines, the looper is usually disposed in an area complicated by other mechanisms, i.e. feed mechanisms, thread cutters, loop retainers, and etc. Therefore, operator access to the looper, for purposes of servicing, are extremely limited.

Mechanisms for retracting the looper to a threading position by bodily moving the looper are known in the art. Examples of this construction are illustrated in U.S. Pat. Nos. 1,912,959; 2,029,233; and 3,354,851. With the ever increasing speeds of machines, however, it has been found necessary to compliment these mechanisms with additional features to prevent undesirable movement of the looper from its operative position while the machine is operating.

SUMMARY OF THE INVENTION

The present invention provides an improvement over the heretofore known looper throw-out mechanisms by providing an improved arrangement for bodily moving the looper to a servicable position and for locking the looper in its operative position. To this end, the present invention provides a looper drive shaft having the looper means releasably secured thereto, an operator actuated mechanism including a series of detents for releasably coupling the sewing machine looper to the drive shaft, and a locking mechanism, including another series of detents, for preventing undesirable disconnection of the looper from its actuating shaft. When it is desirable to service or thread the looper, the locking mechanism is released and then the mechanism coupling the looper to its actuating member may be effectively disconnected. The looper may thereafter be moved about the axis of its actuating shaft to a removed position for servicing. Means are further provided for positively securing the looper in its operative position relative the needle's path upon its return.

In line with all of the above, it is a primary object of this invention to provide an improved looper throw-out mechanism for chain stitch sewing machines.

Another object of this invention is the provision of suitable means which will facilitate the servicing of sewing machine loopers and reduce the time required for this operation.

Another object of this invention is to provide a looper throw-out mechanism which may be simply operated at one end of the looper actuating shaft.

Another object of this invention is the provision of a looper throw-out mechanism of the character indicated and which includes means for preventing undesirable looper disconnection from its operating shaft.

Still another object of this invention is to provide a looper throw-out mechanism which may be disposed in a convenient manner to the operator but yet which prevents undesirable disconnection of the looper from its actuating means.

Other objects and a fuller understanding of the invention may be had by referring to the following disclosure and appended claims taken in conjuction with the accompanying drawings in which:

DETAILED DESCRIPTION OF A PREFERRED EMBODIMENT

Figure 1:
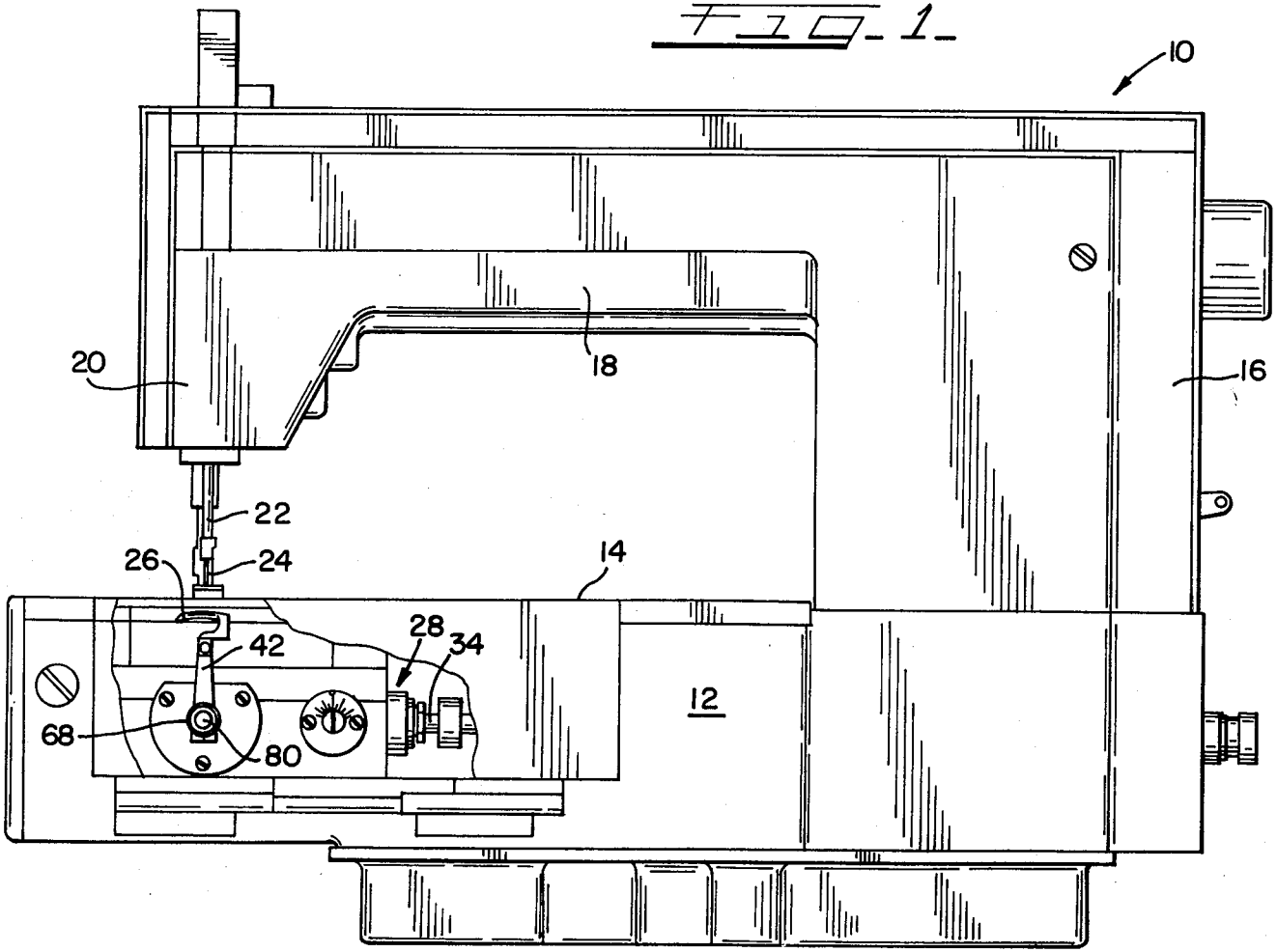
FIG. 1 is a front elevational view of a sewing machine incorporating the present invention.

Referring now to the drawings, wherein like reference numerals indicate like parts throughout the several views, and more particularly to FIG. 1, there is schematically shown a two thread chain stitch sewing machine 10 including a frame having a base portion or bed 12 provided with a work supporting surface 14, a vertically extending standard 16, an arm 18 which overhangs the bed and terminates in a sewing head 20. Mounted for endwise reciprocation in the sewing head is a needle bar 22 which carries at its lower end one or more thread carrying needle means 24. Arranged in the bed beneath the needle bar is a thread carrying looper means 26 which is adapted for cooperation with the needle means to conventionally form chain stitches in a work piece being advanced through the sewing station of the machine. It should be appreciated, however, that the present invention is equally applicable to machines having more than one looper. In the particular embodiment shown, the looper is driven such that it simultaneously partakes of an oscillatory and rocking motion. That is, the looper moves endwise across the path of needle reciprocation to seize and shed needle thread loops and also includes an alternating sideways motion to avoid the needle means alternatively on opposite sides thereof. The four motion path which the looper is required to execute is well known in the sewing machine industry for sewing chain stitches (Federal Stitch Type 401).

Figure 2:
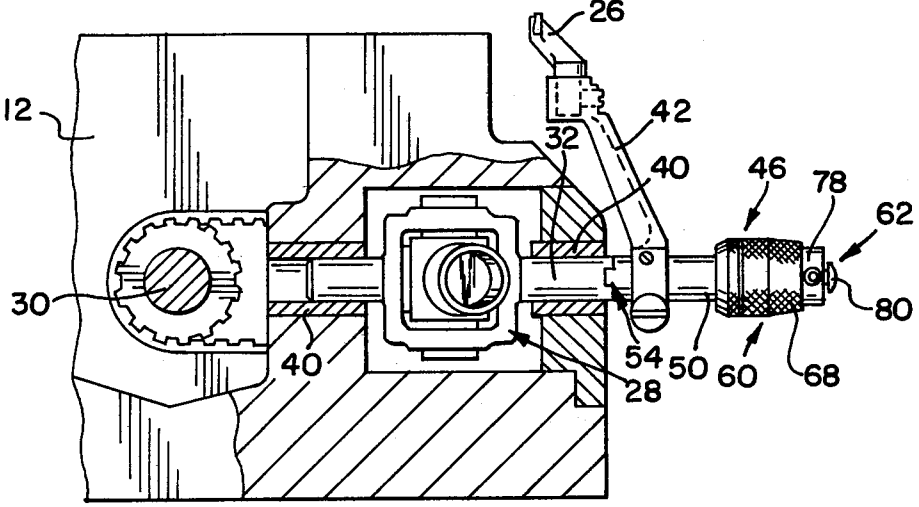
FIG. 2 is a end elevational view, partly in section, showing the present invention.
Figure 3:
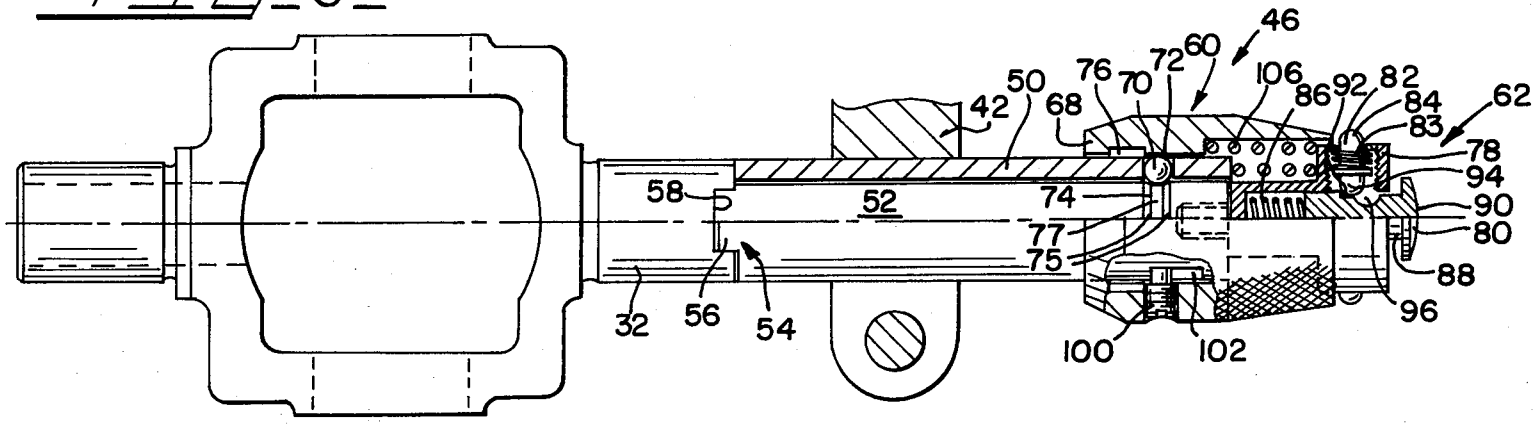
FIG. 3 is an enlarged view of the present invention shown removed from its work environment.

In order to drive the looper in the required motion and in timed relation to the reciprocation of the needle, a looper drive mechanism 28 is provided. As may be best described in connection with FIG. 2, the looper drive mechanism is operatively connected to a revoluble shaft 30 arranged in the machine bed 12. The looper drive mechanism includes a segmented looper supporting shaft means 32 which, at one end, is operatively connected to the revoluble input shaft 34 (FIG. 1) of the looper drive mechanism. In this manner, the requisite endwise reciprocation and sideways or rocking movements are imparted to the looper means which are releasably connected to the other end of the actuating shaft 32. The looper actuating mechanism may be constructed similar to that disclosed in U.S. Pat. No. 2,998,787 granted Sept. 5, 1961 to K. Pollmeier, the full disclosure of which is incorporated herein by reference. Suffice it to say, that as seen in FIG. 3, the actuating shaft means 32 projects beyond the machine bed and is characterized by a long, segmented bearing journal having first and second portions 52 and 50, respectively. Referring again to FIG. 2, the actuating shaft is mounted in the frame in suitable fixed bearing blocks 40. By this construction, it will be clear, that the shaft is constrained to move only about and along its longitudinal or center axis.

Clamped on the extended free end of the actuating shaft is a looper carrier means 42. Thus, the looper carried thereby partakes of the motion of the shaft. As shown in FIG. 1, the looper carrier is adpated to have one or more loopers 26 secured at its free end and serves to position same proximate the work supporting surface 14. Because of the limited space available beneath the needle, when it is necesary to service the looper, it is desirous to bodily move same out of its normal operating position to a more convenient retracted position. To this end, the present invention is provided.

In order to conveniently accomplish the above result and lock the looper in an operative position, the present invention provides a looper throw-out mechanism, generally designated 46. The looper throw-out mechanism of the present invention permits a releasable connection to be established between the looper and its operating shaft. The looper throw-out mechanism includes an actuated looper support means 50 which forms the second portion or part of the segmented shaft means 32. In the preferred embodiment, the other portion 52 of the actuating shaft serves as a supporting post providing a pivotal support for the free movement of the looper. The looper supporting carrier 50 is freely arranged as a sleeve over the supporting post and is adapted for movement along and about the central axis thereof. That is, the looper carrier or support is free to turn or laterally move endwise on the supporting post so far as the direct connection between the post and the carrier 50 are concerned. The looper carrier means or second portion 50 and the second portion 50 of the means shaft 32 are provided with a releasable coupling 54 adapted to maintain the first and second portions in a definite rotational position relative each other. As shown in FIG. 3, the releasable coupling includes mutually engagable and interlocking elements which, in one form, may include a series of outwardly projecting lugs 56 arranged on the carrier and which are adapted to engage complimentary recesses 58 provided on the first portion of the operating shaft 32. In this manner, the operating shaft acts as an actuating member and the looper carrier means 50 is an actuated member.

In keeping with the invention, means are provided for locking the looper bar carrier to the actuating shaft in an operative position during machine operation and which permits the selective release of the actuated looper bar carrier by the operator to enable looper movement to a retracted or servicable position. The locking or holding means includes a first yieldable latch or locking mechanism 60 which serves to maintain an operative coupling between the actuated looper carrier and actuating shaft during machine operation, and a second yieldable latch or locking mechanism 62 which may effectively release said first holding mechanism whereby permitting the looper carrier and associated members to be moved to a nonoperative position. In the presently preferred embodiment, the first locking mechanism 60 includes a series of operator responsive means. More particularly, and as may be best seen in FIG. 3, the first holding mechanism includes a sleeve or hub 68 which is telescopically received about the looper support means 50 and is laterally or endwise movable relative thereto. Interposed between the inner surface of the sleeve 68 and the outer surface of the support post or member 52 are a plurality of detents or balls 70. The distal end of the looper support means 50 is provided with a series of equally spaced radial apertures 72 in which the balls or detents 70 are carried as will be described. The supporting post 52 is provided with a relieved section 74 capable of receiving the detents in a manner whereby the looper carrier 50 is secured against endwise displacement relative to the supporting post 52. In addition, the sleeve or member 68 includes an annular recess or groove 76. The groove 76 being adapted to receive and carry the detents past the relieved section 74 to permit the sleeve 60 and looper carrier 50 to be laterally moved relative the support post 52 whereby disconnecting the coupling and thereby permitting the bodily movement of the looper to a serviceable position. Preferably, the groove 76 is rectangularly shaped and the relieved section 74 has oppositely tapered sides 75 connected by a cylindrical central section 77.

In its preferred form, the distance between the inner surface of the sleeve 68 and the bottom of the relieved section 74 should approximately equal the diameter of the ball elements 70. Likewise, the distance between the peripheral surface or outside diameter of the supporting post 52 and the bottom of groove 76 should also approximately equal the diameter of the ball elements 70. Preferably, the wall thickness of the carrier 50, the depth of the groove 76, and the depth of the relieved section 74 should each approximately equal one-half the diameter of the ball elements 70. These dimensions permit the sleeve 68 to assume its operative position shown in FIG. 3 and also allows movement of the ball elements out of and past the relieved section 74 when they are held in the recessed groove 76.

The second locking or holding means 62 includes a shouldered annular housing 78, a relatively movable actuating plunger means 80 and a series of equally spaced, spring actuated detents 82. In the preferred embodiment, the annular housing 78 is threadably secured to the distal end of the shaft 52. The detents normally project outward in a radial direction from the central axis of the acutating shaft and beyond the annular housing 78. The second locking assembly is arranged such that one end 84 of each detent project into the laterally movable path of the sleeve 68. In this manner, the first holding assembly cannot be released unless the second holding assembly and more particularly, the detents thereof, have been influenced or released by the operator.

The actuating plunger means 80 of the second holding assembly is normally biased into a first position (FIG. 3) by a compression spring 86. The plunger means has a stem portion 88 against which the detent 82 is biased by the action of a spring 83. The plunger 80 may also be provided with an end cap 90 which protrudes beyond the housing 78 so that the plunger may be moved against the force of the spring 86 by exerting a suitable force against the end cap 90. At its other end, the plunger is provided with a shoulder or retaining means 92 which combines with the second end 94 of the detents to hold the plunger within the housing 78. Intermediate its ends, the stem portion 88 of the plunger is provided with a camming surface defined by a recessed annular groove 96. The groove 96 is adapted to receive the second end of the detents 94 when the plunger is moved to a second position whereby removing the first end 84 of the detents from the linear path of the sleeve 68 thus permitting the first locking means to be released.

The looper throw-out of the present invention also provides means for positively securing the looper in an operative position after having been removed therefrom. From FIG. 3, it may be noted that the sleeve 68 is provided with a series of equally spaced, radially extending set screws or fasteners 100. One end of each fastener is adapted to be received in a peripheral groove 102 provided on and extending parallel with the center axis of the looper carrier 50. A spring 106, adapted to bear against the housing 78 and the sleeve 68, yieldably forces coupling 56 and the segmented shaft portions 32 and 50 through the action of the screws or fasteners 100 together. Other methods could be conceived for accomplishing this purpose, the disclosed means being shown are to merely serve as one method of accomplishing the desired result. Thus, after the looper has been serviced and the interengaging elements of the coupling are returned, a positive force will assure a mutual association between the elements during the machine operation.

The operation of the locking means is apparent to one skilled in the art. As best seen in FIG. 3, when the looper carrier is in an operative position, the sleeve 68 is yieldably urged under the influence of spring 106 to its first or foward position with the detents 70 being located or arranged in the relieved section 74 and in the apertures 72 of the looper carrier 50. The action of the spring 106 also serves to maintain the coupling in its operative order. With the sleeve in such a position, the detents or balls serve to lock or hold the carrier against lateral displacement relative the actuating shaft whereby assuring that the interengaging segments of the coupling will be held in operative association. With the sleeve 68 in the position shown in FIG. 3, the cammed projection of the detents of the second locking assembly into the movable path of the sleeve 68 prevents the mistaken or unwanted disconnection of the first holding means during machine operation.

Removal of the looper means 26 to a servicable position may be easily accomplished. First, the second holding or locking means 62 is activated thus allowing the release of the first holding means thereby permitting movement of the looper to its servicable position. More particularly, to activate the second holding assembly, the plunger is moved from its normal extended position toward the bed of the machine such that the camming action of the plunger on the second end of the detents, combined with the action of the spring 83, removes the operative locking effect of the second holding means relative the sleeve 68. Having removed the detents from its lateral path, the sleeve 68 is free to move relative to the looper carrier 50 and against the action of the spring 106. Next, the sleeve is laterally moved to a preset position whereat the annular groove 76 of the sleeve is positioned at the detent or balls of the first locking assembly. Continued movement of the sleeve 68 causes the looper carrier 50, through the operative association of the screws 100 with the extremity of the slot 102, to also move relative the supporting post 52. The combined movement of the slide and looper carrier 50 cause the detents to be urged from the recessed groove 74 and into the annular groove 76 on the sleeve 68. Once the detents are forced or displaced into the annular groove 76, the looper support carrier 50 is free to move laterally outward past the annular groove 74 on the supporting post 52 to an extend position allowing disconnection of the coupling elements 54. Once the coupling is disengaged, the looper is free to turn about the central axis of the looper actuating shaft to a removed position.

In view of the foregoing it can be seen and readily appreciated that the Looper Throw-out Mechanism and its associated locking or holding mechanism facilitate precise but quick positioning and removal of the looper relative to an operative position. When necesary to service the looper, the operator may release the second locking assembly 62 thereby permitting the sleeve 68 to be moved against the action of the spring 106. Such action will disengage the interconnecting coupling 54 and will permit the operator to move the looper means to a position more accessible for servicing. When the loopers have been serviced, the operator merely returns the looper carrier until the interengaging coupling 54 comes into register and the spring 106 will automatically couple the segmented portions of the looper actuating shaft together. When the segmented actuating portion of the shaft is coupled to the segmented acutated part of the shaft, movements may be imparted to the looper means in proper timing with the reciprocation of the needle means. Having once returned to the sleeve 68 to its operative position, the second locking means is automatically actuated whereby preventing unwanted disconnection of the loopers from this operative position. In other words, the loopers may be easily disconnected from their actuating means, but the connection to the same may be very quickly reestablished and when established the parts are in their proper timing.

Thus it is apparent that there has been provided, in accordance with the invention, A SEWING MACHINE LOOPER THROW-OUT MECHANISM that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described the invention, what I claim is:

1. In a sewing machine including a revoluble shaft means, reciprocal needle means, looper means adapted for cooperation with said needle means in forming chain-stitches, and a looper mechanism comprising:

a looper carrier means;

a segmented drive shaft having a first portion operatively associated with said revoluble shaft means in a manner imparting oscillatory rocking movement to the looper carrier means arranged on a second portion of said segmented shaft;

looper throw out means for bodily displacing said looper carrier means to a retracted position, said looper throw out means including means for urging the first and second portions of said drive shaft into operative association relative to one another, locking means for operatively maintaining the first and second portions of said drive shaft in an operative association, said locking means includes a plurality of radially disposed apertures in said second portion on said shaft, a groove in said first portion of said shaft, locking elements disposed in each of said apertures for radial movement between a locked position within said aperture and a groove and an unlocked position within said aperture, and an operator controlled hub arrnaged about said second shaft portion and said locking elements permitting movement of said locking elements from said locked position to said unlocked position, and operator controlled means which upon release allow movement of said hub whereby permitting the release of said first and second portions from each other such that the looper carrier means may be moved to its retracted position.

* * * * *